US008209922B2

(12) United States Patent
Petersen

(10) Patent No.: US 8,209,922 B2
(45) Date of Patent: Jul. 3, 2012

(54) BUILDING OR WINDOW ELEMENT AND A METHOD OF PRODUCING A BUILDING

(75) Inventor: Lars Petersen, Kolding (DK)

(73) Assignee: Fiberline A/S, Kolding (DK)

( * ) Notice: Subject to any disclaimer, the term of this patent is extended or adjusted under 35 U.S.C. 154(b) by 947 days.

(21) Appl. No.: 10/585,487

(22) PCT Filed: Jan. 10, 2005

(86) PCT No.: PCT/DK2005/000008

§ 371 (c)(1),
(2), (4) Date: May 15, 2009

(87) PCT Pub. No.: WO2005/066444

PCT Pub. Date: Jul. 21, 2005

(65) Prior Publication Data

US 2009/0301008 A1 Dec. 10, 2009

(30) Foreign Application Priority Data

Jan. 9, 2004 (EP) ..... 04388003
Mar. 5, 2004 (EP) ..... 04388015

(51) Int. Cl.
*E06B 3/54* (2006.01)

(52) U.S. Cl. ..... 52/204.62; 52/235; 52/308; 52/786.13; 52/801.1; 428/34

(58) Field of Classification Search ..... 52/204.5, 52/204.62, 786.1, 786.13, 800.1, 801.1, 172, 52/306, 308, 235; 428/34
See application file for complete search history.

(56) References Cited

U.S. PATENT DOCUMENTS 2,205,522 A * 6/1940 Fix ..... 52/203
3,266,207 A * 8/1966 Birum, Jr. ..... 52/459
3,316,681 A * 5/1967 Eber ..... 52/235
4,464,874 A * 8/1984 Shea et al. ..... 52/204.593
4,523,414 A * 6/1985 Horgan, Jr. ..... 52/204.1
(Continued)

FOREIGN PATENT DOCUMENTS

DE 35 20 973 12/1986
(Continued)

OTHER PUBLICATIONS

Machine translation of FR2708030 4 pages pritned Jun. 14, 2011.*

*Primary Examiner* — Robert Canfield
(74) *Attorney, Agent, or Firm* — Klein, O'Neill & Singh, LLP

(57) ABSTRACT

A building element includes a glass panel defining an outer circumferential rim including at least two rectilinear segments, a first one of which defines a first length and a second one of which defines a second length. The glass panel is made of hardened glass and has a specific coefficient of thermal expansion. The building element further includes a first pultruded element having a length corresponding to the first length, and a second pultruded element having a length corresponding to the second length. The first and second pultruded elements are adhered in a high strength integral adhesion to the hardened glass panel along the first and second rectilinear segments, respectively, and the pultruded elements have a content of reinforcing fibers for providing a coefficient of thermal expansion of the pultruded elements substantially corresponding to the specific coefficient of thermal expansion.

11 Claims, 4 Drawing Sheets

U.S. PATENT DOCUMENTS

| | | | | | |
|---|---|---|---|---|---|
| 4,551,364 | A | * | 11/1985 | Davies | 428/34 |
| 4,564,540 | A | * | 1/1986 | Davies et al. | 428/34 |
| 4,652,472 | A | * | 3/1987 | Davies | 428/34 |
| 4,831,799 | A | * | 5/1989 | Glover et al. | 52/172 |
| 4,893,443 | A | * | 1/1990 | Haber | 528/208 |
| 4,984,402 | A | * | 1/1991 | Davies | 52/204.593 |
| 4,994,309 | A | | 2/1991 | Reichert et al. | |
| 5,079,054 | A | * | 1/1992 | Davies | 428/35.8 |
| 5,094,055 | A | | 3/1992 | Berdan | |
| 5,106,663 | A | * | 4/1992 | Box | 428/34 |
| 5,280,686 | A | * | 1/1994 | Davies | 49/209 |
| 5,493,831 | A | * | 2/1996 | Jansson | 52/235 |
| 5,647,172 | A | | 7/1997 | Rokicki | |
| 5,727,356 | A | | 3/1998 | Ensinger et al. | |
| 6,055,783 | A | * | 5/2000 | Guhl et al. | 52/204.62 |
| 6,401,428 | B1 | | 6/2002 | Glover et al. | |
| 6,463,706 | B1 | * | 10/2002 | Guhl et al. | 52/204.62 |
| 6,591,557 | B1 | | 7/2003 | Thomsen et al. | |
| 6,613,404 | B2 | | 9/2003 | Johnson | |
| 6,662,523 | B2 | * | 12/2003 | Hornung et al. | 52/786.13 |
| 6,823,640 | B1 | * | 11/2004 | Pytlewski | 52/677 |
| 7,588,653 | B2 | * | 9/2009 | Crandell et al. | 156/109 |
| 7,856,770 | B2 | * | 12/2010 | Grassmuck et al. | 52/204.593 |
| 2002/0069600 | A1 | | 6/2002 | Bryant | |
| 2003/0037493 | A1 | | 2/2003 | Guhl et al. | |
| 2004/0231255 | A1 | * | 11/2004 | Silverman | 52/204.6 |
| 2008/0313963 | A1 | * | 12/2008 | Thorning | 49/383 |

FOREIGN PATENT DOCUMENTS

| | | | | |
|---|---|---|---|---|
| EP | 0 113 2090 | A2 | * | 7/1984 |
| EP | 0328823 | | | 8/1989 |
| EP | 0 489 189 | A1 | * | 6/1992 |
| EP | 0517702 | | | 12/1992 |
| FR | 2 708 030 | A1 | * | 2/1995 |
| WO | WO 86/05224 | | | 9/1986 |
| WO | 91/08366 | | * | 6/1991 |
| WO | WO 91/19863 | | | 12/1991 |
| WO | WO 95/23270 | | | 8/1995 |
| WO | WO 99/23344 | | | 5/1999 |
| WO | WO 00/05474 | | | 2/2000 |
| WO | WO 00/45003 | | | 8/2000 |
| WO | WO 01/25581 | | | 4/2001 |
| WO | WO 02/096623 | | | 12/2002 |
| WO | WO 03/062578 | | | 7/2003 |
| WO | 2005/066444 | A1 | * | 7/2005 |

* cited by examiner

BUILDING OR WINDOW ELEMENT AND A METHOD OF PRODUCING A BUILDING

CROSS-REFERENCE TO RELATED APPLICATION

This application is a national phase filing, under 35 U.S.C. §371(c), of International Application No. PCT/DK2005/000008, filed 10 Jan. 2005, the disclosure of which is incorporated herein by reference in its entirety.

FEDERALLY SPONSORED RESEARCH OR DEVELOPMENT

Not Applicable

BACKGROUND OF THE INVENTION

The present invention relates generally to the technical field of building and window structures and in particular to a novel building element and a building structure made from a plurality of building elements.

Within the technical field of building elements, prior art patent applications describing building elements to be included in the building of a house or office building are known. The publications include WO 86/05224, WO 95/23270, WO 99/23344, WO 00/05474, WO 01/25581, WO 02/096623, U.S. Pat. No. 4,994,309, U.S. Pat. No. 5,727,356, U.S. Pat. No. 6,401,428, US 2002/0069600, US 2003/0037493, U.S. Pat. No. 6,591,557 and EP 0 328 823.

Previously, when constructing a building or part of a building such as a front, facade or shop front, methods including building a skeleton or framework of aluminum or steel as the loadcarrying part have been used. E.g. when constructing an office building having a large facade in glass, a metal framework carrying the entire load of the facade was constructed, and on this steel skeleton, fixtures were mounted for fixating and holding window panes. The present invention provides a high strength building element having good thermal insulating properties.

Pultruded fiber glass framing sections have been described previously in patent publications such as U.S. Pat. No. 5,647,172 and EP 0 517 702. The pultruded elements described in these publications are of relatively high complexity and do now allow for multiple elements to be mounted directly together to form structures such as glass facades of buildings.

Building elements comprising pultruded elements have also been described previously in publications such as WO 91/19863 and WO 00/45003.

Glazed window structures comprising pultruded elements have also been described previously in publications such as WO 01/25581, WO 03/62578, U.S. Pat. No. 6,401,428, U.S. Pat. No. 6,613,404, EP 0 328 823, U.S. Pat. No. 4,994,309 and U.S. Pat. No. 5,094,055.

The above-mentioned US publications are hereby incorporated in the present description by reference.

The applicant company is a world-wide leading manufacturer of pultruded structures and has delivered pultruded profiled elements for the building of e.g. bridges and also houses such as the Fiberline Bridge located in Kolding in Denmark and, the Eye Catcher building built in Zurich in Switzerland. The advantageous properties of pultruded structural elements as to bearing capability, strength, low weight and further thermal insulating properties is well documented within the industry, e.g. in the manuals delivered by the manufacturers of profiled pultruded elements and in particular by the applicant company including the online design manual available from the applicant company.

SUMMARY OF THE INVENTION

It is an object of the present invention is to provide a novel technique of building houses by means of a novel building element which is made from high strength and lightweight elements, in particular a glass panel and highly insulating pultruded elements.

It is a further object of the present invention to provide a novel technique of manufacturing glazed windows providing a high degree of integration of the various elements of the glazed window and at the same time utilizing the advantageous thermal insulating properties of components or elements made by pultrusion or similar manufacturing technique.

It is a particular feature of the present invention that the use of pultruded structure elements in combination with multilayer structures such as glazed window structures allows the manufacture of light weight window structures in which fixtures, hinges, closures, etc. may be arrested relative to the light weight pultruded elements which at the same time due to their high thermal insulating capabilities provide excellent glazed window structures of high insulating capability. Furthermore, the use of light weight, highly insulating and high strength pultruded elements in combination with glass panels provide high pressure strengths and high tensile strengths building element or glazed window structures.

The basis for the present invention is the realization that pultruded bodies provided a specific content of fiber material and a specific selection of fiber material be made may be combined with high strength hardened glass panels, such as self supporting glass panels or glass panels made from laminated or hardened glass, for providing high strength and highly stable building elements which may stand exposure to temperature variation without giving origin rise to excessive stresses in the joints between the materials being glass panels and pultruded bodies.

It is an advantage of the present invention that the novel technique of building elements from a combination of integrally joined glass panels and profiled pultruded bodies renders it possible to manufacture large glass panel elements and further in a particular aspect renders it possible to integrally manufacture a glazed window from a single profiled pultruded body constituting the distance element and also the frame of the window element in which the glass panel constitutes a window pane.

In the present context, the expression glass panel is used as a generic term covering a sheet-like glass element used in a specific structure such as a building element or window element and may in some applications constitute an element similar to the structural element conventionally known as a window pane.

In the present context, the technique defined as pultrusion is to be considered comprising any technique resembling the technique conventionally known as pultrusion involving the pulling of reinforcing fibers or layers through an extrusion die and involving the utilization of thermosetting resins and further equivalent techniques such as coextrusion/pultrusion, extrusion of fiber reinforced thermoplastics materials or a technique known as pulforming in which a pre-cast or pre-extruded polymer body is formed into a specific shape by pulling the pre-cast or pre-extruded element or body.

The above object, the above feature and the above advantage together with numerous other objects, advantages and features which will be evident from the below detailed description of the present invention is according to a first aspect of the present invention obtained by a building element comprising:

a glass panel defining an outer circumferential rim including at least two rectilinear segments, a first one of which defines a first length and a second one of which defines a second length, the glass panel having a specific coefficient of thermal expansion, a first pultruded element having a length corresponding to the first length, a second pultruded element having a length corresponding to the second length, the first and second pultruded elements being adhered in a high strength integral adhesion to the hardened glass panel along the first and second rectilinear segments, respectively, and the pultruded elements having a content of reinforcing glass fibers for providing a coefficient of thermal expansion of the pultruded elements substantially corresponding to the specific coefficient of thermal expansion.

According to the basic teachings of the present invention, a high strength building element is produced from the combination of a glass panel such as a self supporting glass panel, a glass panel made from laminated glass or a hardened glass panel, constituting a structurally load-bearing element and two or more pultruded elements having coefficient of thermal expansion substantially corresponding to the coefficient of thermal expansion of glass, thereby allowing the pultruded elements to be integrally joined to the glass panel without causing excessive thermal stresses in the joint or in either of the two materials, viz. the glass panel or the pultruded elements.

The correspondence between the coefficients of thermal expansion of the fibers and the glass panel and the high content of the fibers having coefficient of thermal expansion substantially corresponding to the coefficient of thermal expansion of glass allows the pultruded elements including a solidified resin and the reinforcing fibers to have a combined resulting coefficient of thermal expansion substantially corresponding to the coefficient of thermal expansion of the glass panel.

In the present context, the combination of the glass panel which is preferably made from hardened glass or laminated glass, is simply made as a window pane which should only exhibit the capability of being self supporting meaning that the window pane or the self supporting glass panel may stand on its one edge without being self destructed by excessive loads generated by the glass panel itself. It is a particular feature of the combination of the glass panel and the pultruded elements characteristic of the building element according to the present invention that the glass panel may stand high pressure loads whereas the pultruded elements have high tensile strength and therefore, the combined structure exhibits excellent properties as to its pressure and tensile strength capability.

As indicated above, any fiber material exhibiting a coefficient of thermal expansion substantially corresponding to the coefficient of thermal expansion of glass may be used as the reinforcing fiber material provided the reinforcing fiber material exhibits adequate and sufficient strength and stiffness. At present the preferred reinforcing fibers having a coefficient of thermal expansion identical to glass are, as already mentioned, glass fibers.

Within the technical field of pultrusion, many different fibers have been used, in particular glass fibers, carbon fibres and KEVLAR® fibers. In the present context, glass fibers are preferably used, however, in specific applications, additional fibers such as carbon fibers, KEVLAR® fibers, or natural fibers may be added used in addition to the glass fibers.

In the present context, the fulfillment of the requirement of substantial correspondence between the coefficient of thermal expansion of the reinforcing fibers and the glass and further between the combined pultruded elements and the glass panel depends on the actual application of the building element such as the temperature variation to which the building element is to be exposed and further the dimensions of the building element. However, it is contemplated that the fulfillment of the criteria of substantial correspondence between the coefficient of thermal expansion be any difference between the coefficient of thermal expansion being less than 40%, such as 10%-40%, e.g. 20%, preferably approximately 5%-10%, 10%-15%, 15%-20%, 20%-25%, 25%-30%, 30%-35% or 35%-40%.

According to the presently preferred embodiment of the building element according to the first aspect of the present invention, the content of reinforcing fibers, preferably being constituted by glass fibers, is larger than 40%, such as 40%-50%, 50%-60%, 60%-70%, 70%-80%, 80%-90%, 90%-95%, preferably 50%-80% such as 60%-70%, all percentages by weight.

It is to be understood that the content of reinforcing fibers to some extent depeneds on the coefficient of thermal expansion of the solidified or hardened resin as a resin having a coefficient of thermal expansion highly different from the coefficient of thermal expansion of glass may necessitate the use of a higher content of reinforcing fibers. The resin used in according with the teachings of the present invention is preferably a polyester resin, however, as is well known within the art of pultrusion, also vinyl ester, phenols and epoxy resin may be used for the pultrusion process.

For most applications of the building element constituting a first aspect of the present invention, the glass panel is of a rectangular configuration, however, the technique of providing a building element as taught by the present invention is by no means limited to the geometrical configuration of a rectangular panel as triangular panels, polygonal panels etc. may be manufactured in accordance with the teachings of the present invention.

For some applications, additional pultruded elements made from the same materials and having the same reinforcing fiber content as the first and second pultruded element may be used for providing a circumferential frame e.g. in a rectangular building element as the first and second pultruded elements are positioned along the longer sides of the rectangular hardened glass panel and the additional pultruded elements are positioned along the short sides of the rectangular, hardened glass panel.

The adhesion of the pultruded element or elements to the hardened glass panel may be established by means of any appropriate adhesive material taking into consideration the thermal stresses to be transferred from the glass panel to the pultruded elements or vice versa. It is contemplated that PU adhesives or alternatively epoxy resins may be used for the fixation of the pultruded elements along the rectilinear segments of the glass panel according to the teachings of the present invention.

The technique of providing a building element as discussed above allows the building element to be converted into an integrally glazed window structure in which the two or more pultruded elements constitute a window frame and in which a further glass panel made from non-hardened glass or alternatively hardened glass is positioned in spaced apart relationship relative to the hardened glass panel by means of distance elements which may be constituted by conventional aluminum or stainless steel distance elements or alternatively constituted by extensions of pultruded elements.

In the glazed window structure constituting a further embodiment of the building element according to the present invention, the pultruded elements may extend from the front window pane or alternatively from the rear window pane when considering the window structure as a window facing the exterior of a building.

The building element or glazed window structure according to the present invention allows, due to the use of the pultrusion technique, the integration of a gas tight foil such as an aluminum or stainless steel foil into the distance element by integrating the gas tight foil into the pultruded profile during the process of manufacturing the pultruded profile from which the distance elements are cut. Furthermore, the pultrusion technique allows the integration of a vapor absorbing substance such as a silica gel substance or a PU foam into the distance elements in an integral structure or alternatively by positioning the PU foamed element or a silica gel supporting extrusion string in the gas tight foil within the inner space defined between the gas panels of the building element or glazed window according to the present invention.

In the present specification all terms such as 'up', 'down', 'vertical', 'horizontal', 'front', 'rear' etc. are to be construed in the context of the intentional application of the structural elements in question and by no means to be referred to as limiting definitions of orientations referring to e.g. the orientations of elements during the process of manufacturing the building element.

Provided the integral glazed Window structure is to be produced from the profiled pultruded elements having extensions constituting the distance elements of the glazed window, a gas tight seal is preferably further applied to the extensions of the pultruded elements for providing a gas tight sealing between the two glass panels constituting window panes of the glazed window structure.

The above object, the above feature and the above advantage together with numerous other objects, advantages and features which will be evident from the below detailed description of the present invention is according to a second aspect of the present invention obtained by a building structure having a facade or a part of a facade made from a plurality of building elements each having any of the features of the building element and being assembled into a composite multi-element structure including elements extending horizontally and elements extending vertically.

The above object, the above feature and the above advantages together with numerous other objects, advantages and features which will be evident from the below detailed description of the present invention is according to a third aspect of the present invention obtained by a method of producing a building element comprising:

- providing a glass panel defining an outer circumferential rim including at least two rectilinear segments, a first one of which defines a first length and a second one of which defines a second length, the glass panel having a specific coefficient of thermal expansion,
- providing a first pultruded element having a length corresponding to the first length,
- providing a second pultruded element having a length corresponding to the second length, the pultruded elements having a content of reinforcing fibers for providing a coefficient of thermal expansion of the pultruded elements substantially corresponding to the specific coefficient of thermal expansion, and
- adhering the hardened glass panel to the first and second pultruded elements in a high strength integral adhesion along the first and second rectilinear segments, respectively.

The method of producing a building element according to the third aspect of the present invention may comprise any of the features discussed above in the description of the building element according to the first aspect of the present invention.

The above object, the above feature and the above advantages together with numerous other objects, advantages and features which will be evident from the below detailed description of the present invention is according to a fourth aspect of the present invention obtained by a method of producing a building structure having a facade or a part of a facade made from a plurality of building elements being produced in accordance with the method according to the third aspect of the present invention and having any of the features of the building element according to the first aspect of the present invention and being assembled into a composite multi-element structure including elements extending horizontally and elements extending vertically.

BRIEF DESCRIPTION OF THE DRAWINGS

The present invention is now to be further described with reference to the drawings, in which.

DETAILED DESCRIPTION OF THE INVENTION

Figure 1:
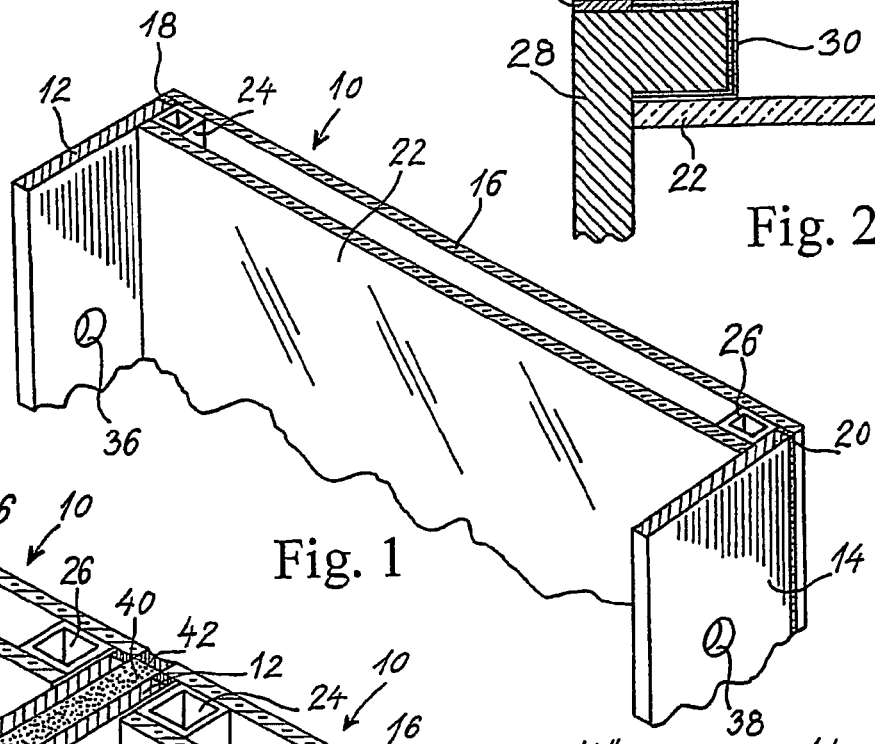
FIG. 1 is a perspective, schematic and partly cutaway view of a first embodiment of a panel or window structure constituting a first embodiment of a building element according to the present invention.

In FIG. 1, a first embodiment of a building element according to the present invention is shown designated the reference numeral 10 in its entirety. The building element may constitute a wall element, a facade element or a window element of a building structure exhibiting extremely lightweight, high strength and high thermal insulating properties.

Basically, the building element is composed of three elements, viz. a glass panel 16 and two lightweight and high strength pultruded bodies 12 and 14 which are made from a resin such as a polyester or epoxy resin having a high content of glass fibers for providing a coefficient of thermal expansion of the profiled bodies substantially corresponding to the coefficient of thermal expansion of glass. The two pultruded bodies 12 and 14 may be of identical configuration such as the shape of a rod or may alternatively have profiled configuration for allowing the bodies to be joined to additional building elements or serving as structural elements in which channels may be provided for e.g. electrical cables or optical wires, e.g. for the main supply, for computer networks, for signalling applications, telecommunication applications, etc. or alternatively for conducting water or air.

The glass panel 16 is made from hardened glass and which adhered by means of a high strength adhesive such as epoxy or PU adhesive to the front edges of the pultruded bodies 12 and 14 so as to position the outer edges of the pultruded bodies 12 and 14 in continuation of the vertical edges of the glass panel 16.

The adhesive function between the pultruded body 12 and the glass panel 16 is designated by the reference numeral 18, and the adhesive junction between the pultruded body 14 and the glass panel 16 is designated by the reference numeral 20.

The glass panel 16 together with the two pultruded bodies 12 and 14 constitute an integral lightweight, high strength and highly stable building element in which the glass panel is used as a structural element rather than a simple decorative or light transparent glass panel. The correspondence between the coefficients of thermal expansion of the pultruded bodies 12 and 14 and the glass panel 16 allows the building element to be subjected to thermal variation, provided that the glass panel constitutes an outer glass panel as the temperature varies from night to day and from winter to summer.

The glass panel 16 preferably constitutes the one panel of a two or three-ply glazed window as the glass panel 16 is jointed to a further glass panel 22 by means of two distance bodies 24 and 26. The two glass panels 16 and 22 together with the distance bodies 24 and 26 constitute the structure of a conventional glazed window. Whereas the glass panel 16 is made of hardened glass for obtaining the adequate strength and load carrying capability of the panel within the building element structure, the glass panel 22 need not be made from a hardened glass material.

The distance bodies 24 and 26 are preferably made from stainless steel or aluminum and are adhered to the sandwiching glass panels 16 and 22 by means of an adhesive material such as epoxy, PU adhesive or silicone. The inner volume defined between the two glass panels 16 and 22 may be pressurised or evacuated dependent on the size of the panels and also the properties of the glass panels used.

Figure 2C:
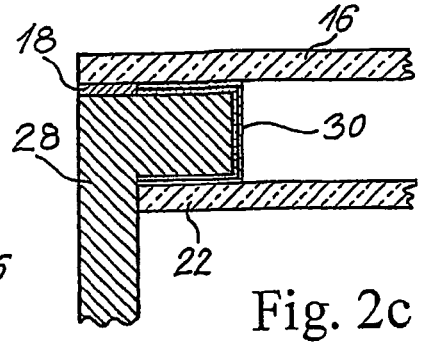
FIG. 2*c* is a sectional view similar to the views of FIGS. 2*a* and 2*b* illustrating a third modified version of the building element according to the present invention.
Figure 2A:
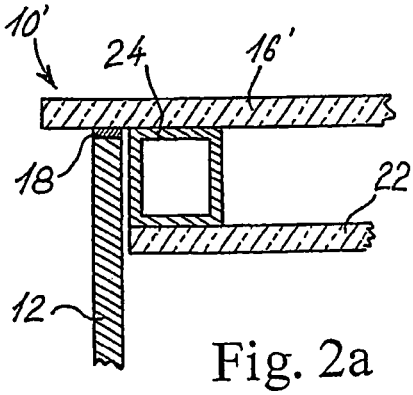
FIG. 2*a* is a sectional view of a first modified version of the first embodiment of the building element shown in FIG. 1.

In FIG. 2*a*, a detail of a first modified version of the first embodiment of the building element 10 shown in FIG. 1 is illustrated which modified version is designated by the reference numeral 10' in its entirety. In the below description, components or elements identical to components or elements, respectively, previously described are designated by the same reference numerals as previously used, whereas components or elements serving the same purpose as components or elements, respectively, described previously, however, geometrically are differing from the previously described components or elements, respectively, are designated by the same reference integers, however with an added a sign for marking the geometrical difference. In FIG. 2*a*, the modified version differs from the above described first embodiment 10 shown in FIG. 1 in that the glass panel 16' is of a somewhat enlarged size or width providing an overhang relative to the pultruded body 12. Consequently, provided the version 10' shown in FIG. 2*a* is used in an assembly as is to be described below with reference to FIG. 3, a spacing is established between the two pultruded bodies 12.

Figure 2B:
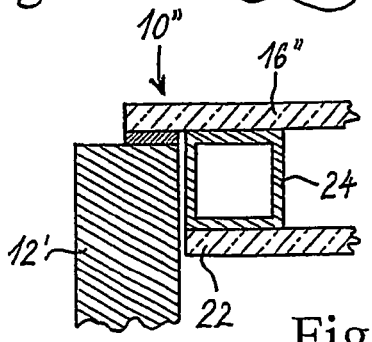
FIG. 2*b* is a sectional view similar to the view of FIG. 2*a* illustrating a second modified version of the building element according to the present invention.

In FIG. 2*b*, a second modified version 10" of the building element is shown differing from the above described first embodiment in that the pultruded body 12 shown in FIG. 1 is substituted by a broader pultruded body 12' providing an overhang relative to the edge of the glass panel 16.

In FIG. 2*c*, a third modified version of the building element 10 shown in FIG. 1 is illustrated in which building element the pultruded body 12 and the distance body 24 are integrated into a single pultruded L-shaped body 28 having a major flange constituting a part similar to the pultruded body 12 and a minor flange serving the purpose as a distance body or element relative to the two sandwiching glass panels 16 and 22. In the glazed window structure shown in FIG. 2*c*, an aluminum foil or similar gas tight foil is used which foil is designated by the reference numeral 30 and serves the purpose of preventing gas from migrating through the material of the pultruded body 28 which is not a gas tight material as distinct from an aluminum foil. The aluminum foil 30 is further glued to the opposing faces of the glass panel 16 and 22 at the outer edges thereof for providing a gas tight, glazed window structure.

Figure 3:
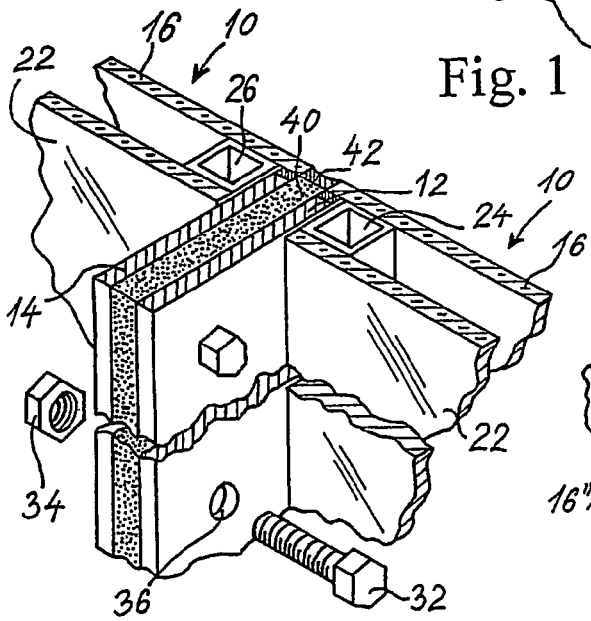
FIG. 3 is a perspective, schematic and partly cutaway view illustrating a technique of assembling two building elements identical to the building element shown in FIG. 1 into a building structure providing a lightweight and high strength building structure.

The building element or window element 10 shown in FIG. 1 is preferably used in a building structure for establishing a self-supporting, lightweight and high strength facade as is illustrated in FIG. 3.

In FIG. 3, two building elements 10 are shown which are joined together by means of bolts and nuts, one bolt being designated by the reference numeral 32 and the one nut being designated by the reference numeral 34 as the bolts and nuts are positioned and received in through-going bores 36 and 38 of the pultruded bodies 12 and 14, respectively, which through-going holes or cores are also shown in FIG. 1. The pultruded body 14 of the left-hand building element 10 and the pultruded body 12 of the right-hand building element 10 are kept in spaced apart relationship by means of an interlayered or sandwiched insulating layer 40 which may be made from foamed material or mineral-fiber material. At the front face, the glass panel 16 of the two building elements 10 are joined by means of a flexible adhesive sealing such as silicone sealing 42. Obviously, the technique of assembling the two building elements or window elements 10 shown in FIG. 3 may be modified in numerous ways by the use of additional or alternative connecting joining components such as by means of separate joining elements, extruded facade decorative elements or as mentioned above additional panel elements, e.g. serving as channels for the receipt of e.g. mains supply cables, communication or network cables, fiber optic cables or air-condition ducts or water channels.

Figure 4:
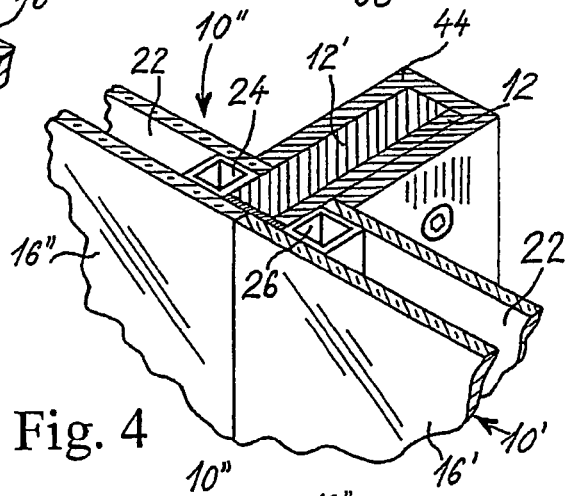
FIG. 4 is a perspective, schematic and partly cutaway view illustrating a technique of assembling the first and second modified versions shown in FIGS. 2*a* and 2*b*, respectively, of the building element into a self-supporting building structure by means of an arresting U-shaped element.

In FIG. 4, an alternative technique of assembling the two adjacent building panels is shown. As in FIG. 4, the building element 10' shown in FIG. 2*a* is joined to the building element 10" shown in FIG. 2*b* as the two building elements are positioned and adjoined side by side by means of a U-shaped element 44 which may be further fixated relative to the pultruded bodies 12 and 12' of the building elements 10' and 10", respectively, by means of screws, bolds or nuts or rivets, etc.

Figure 5A:
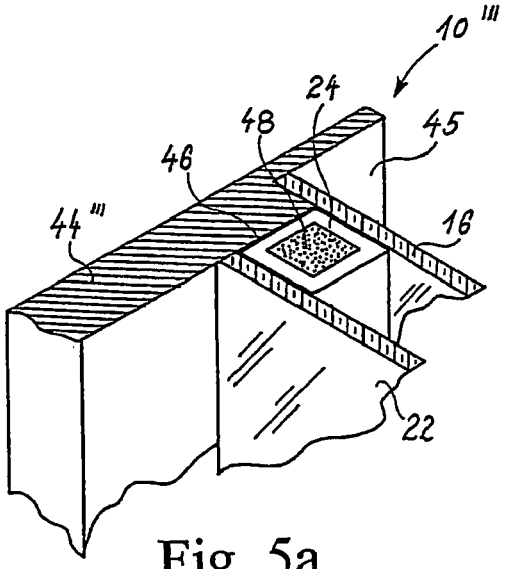
FIGS. 5*a*, 5*b*, 5*c*, 5*d*, 5*e* and 5*f* are perspective, schematic and partly cutaway views illustrating different variants of providing a building element or an integral window frame and glazed window structure according to the present invention.

In FIG. 5*a*, a further embodiment of a building element according to the present invention is shown, which building element constitutes a glazed window having an integral highly insulating frame made from a pultruded element. The building element or glazed window shown in FIG. 5*a* is in its entirety designated by the reference numeral 10'" and comprises the window panels 16 and 22 which are kept in spaced apart relationship by means of the pultruded distance element 24 which is provided with an internal core filling of a water absorbing substance such as a silica gel, which substance is designated by the reference numeral 48. Around the pultruded distance element 24, a vapor barrier foil 46 is positioned extending along the three sides of the element 24 serving to prevent the permeation of gas and particular water vapor into the inner space defined between the two glass panels 16 and 22. The vapor barrier foil is preferably made from aluminum or stainless steel foil.

The building element 10'" shown in FIG. 5*a* is further provided with an integral frame component or wall component 44'" which is preferably made from a pultruded profile as the pultruded body, like the distance element 24 through the adaptation of a specific amount of glass fibers may be adopted to the coefficient of thermal expansion of glass, thereby providing a highly stable integral structure in which stresses due to differences in thermal expansion are to a great extent eliminated or minimized as compared to combined structures including different materials such as plastic, wood, glass, metal, etc.

As compared to the building elements shown in FIGS. 1-4 and discussed above, the pultruded body $\mathbf{44}^{il}$ is provided with an extension flange 45 extending beyond the outer glass panel 16 in order to provide a wind break which may serve to prevent a suction sub-pressure to be generated outside the building element or glazed window structure.

Figure 5B:
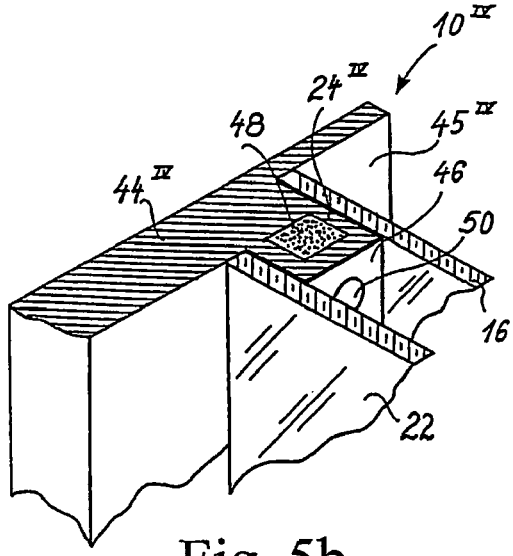

In FIG. 5*b*, a further modified version of the integral building element or glazed window technique according to the present invention is shown, in which structure the distance element $\mathbf{24}^{iv}$ and the frame $\mathbf{44}^{iv}$ are integrated into a single combined body in which the vapor absorbing filling 48 is included integrally within the combined profiled element $\mathbf{24}^{iv}$, $\mathbf{44}^{iv}$. In FIG. 5*b*, the vapor barrier foil 46 is shifted from the position shown in FIG. 5*a* in which the foil faces outwardly relative to the inner space defined between the two glass panels 16 and 22, to a position in which the vapor barrier foil faces the inner space defined between the two glass panels 16 and 22. For allowing any vapor present within the inner space defined between the two glass panels 16 and 22 to be absorbed within the vapor absorbing substance 48 after permeation through the material of the combined distance element and frame element $\mathbf{24}^{iv}$, $\mathbf{44}^{iv}$, a plurality of apertures is provided in the vapor barrier foil 46, one of which apertures is designated the reference numeral 50.

Figure 5C:
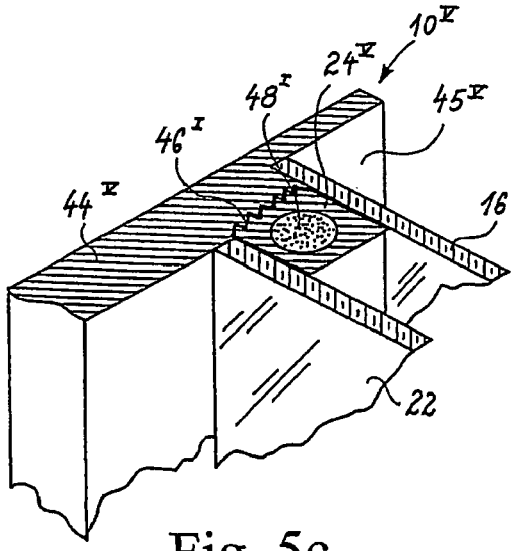

In FIG. 5*c*, a further modified version of the integral building element or glazed window technique according to the present invention is shown. The embodiment shown in FIG. 5*c* is in its entirety designated by the reference numeral $\mathbf{10}^{v}$ and constitutes a further modification of the embodiment shown in FIG. 5*b* as the combined distance element and frame element $\mathbf{24}^{v}$, $\mathbf{44}^{v}$ is in an integral pultrusion/extrusion technique provided with an integralvapor barrier foil $\mathbf{46}^{i}$ and an integral vapor barrier absorbing substance or gel $\mathbf{48}^{i}$. As will be described in greater details below with reference to FIG. 8, the pultrusion technique allows the vapor barrier foil to be integrated into the pultruded structure and at the same time, through a combined extrusion/pultrusion process, the vapor barrier substance may also be integrally included or integrated into the structure rather than being provided as a separate component.

Figure 5D:
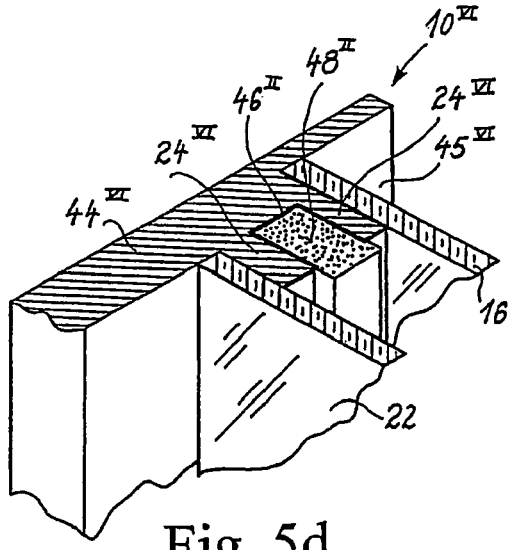

In FIG. 5*d*, the vapor gel is provided as a separate body $\mathbf{48}^{ii}$, which is produced as a foamed polymer string, a pultruded or an extruded polymer profile. In FIG. 5*d*, the integral building element or glazed window structure is designated by the reference numeral $\mathbf{10}^{vi}$ and the combined distance element $\mathbf{44}^{vi}$, $\mathbf{24}^{vi}$ and frame comprises two distance flanges $\mathbf{24}^{vi}$ between which the vapor absorbing string or body $\mathbf{48}^{ii}$ is sandwiched separate from the flanges $\mathbf{24}^{iv}$ by means of the vapour vapor barrier foil $\mathbf{46}^{ii}$.

Figure 5E:
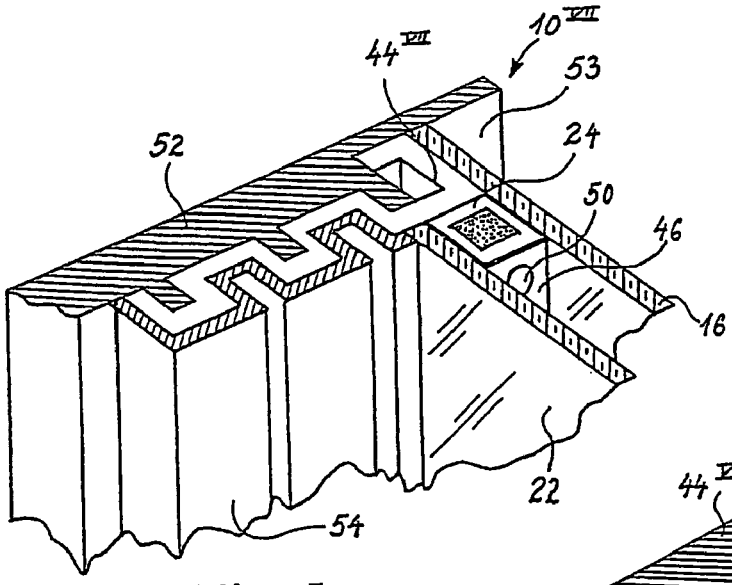

In FIG. 5*e*, a further modified version of the integration technique similar to the embodiment shown in FIG. 5*b* is illustrated as the building element or glazed window structure shown in FIG. 5*a* is designated by the reference numeral $\mathbf{10}^{vii}$. In FIG. 5*e*, the distance element 24 is constituted by a separate body which in an alternative version may be integrated with the frame component $\mathbf{44}^{vii}$. The frame component $\mathbf{44}^{vii}$ is of a meander or square curve configuration allowing the profiled body $\mathbf{44}^{iv}$ to fit into a fixed supporting structure of the building itself or alternatively of a window structure, which structure is designated by the reference numeral 52.

The meander or square curve configured frame element $\mathbf{44}^{vii}$ is further at its inner surface provided with a covering 54 which may serve as a further insulating covering or serve as a support for e.g. an architectural covering such as a wooden panel or similar covering serving mainly aesthetic purpose. In FIG. 5*e*, the components $\mathbf{44}^{vii}$, 52 and 54 are shown fixated relative to one another in a snap fitting structure, however, the profiled frame component $\mathbf{44}^{vii}$ may serve as a fixture for screws, rivets or similar fixation elements or alternatively, the covering 44, which may be made from a softer elastomer material may serve as the fixation support for e.g. screws which are easily fixated in the softer elastomer material rather than in the glass fiber reinforced pultruded profiled body $\mathbf{44}^{vii}$. The structure shown in FIG. 5*e* is contemplated to allow an easy replacement of a glazed window or building element $\mathbf{10}^{vii}$ provided the building element or the glazed window is punctured as the snap fitting allows an easy removal and also an easy remounting of a novel building element.

The building element or glazed window structure shown in FIG. 5*e* further differs from the above described embodiment shown in FIG. 5*a*-5*d* in that the wind breaking profile 45 shown in FIG. 5*a* and the similar wind breaking profiles $\mathbf{45}^{iv}$, $\mathbf{45}^{v}$, $\mathbf{45}^{vi}$ shown in FIGS. 5*b*, 5*c* and 5*d*, respectively, are substituted by a outwardly pultruding flange 53 which constitutes an integral part of the fixed building structure 52 rather than a component of the frame element $\mathbf{44}^{vii}$.

The frame component $\mathbf{44}^{vii}$ shown in FIG. 5*e* may further be used for supporting e.g. electrical cables, telephone or edp, or alternatively supporting tubes for the supply of fresh water or heating water or cooling water in a central heating system or an air-condition system of the building in which the building element or glazed window structure is used. Furthermore, as mentioned above, the frame component $\mathbf{44}^{vii}$ may be used for the fixation of fixtures for the arresting of the glazed window of the building element or glazed window structure or alternatively be used for the fixture of hinges, guiding rails, etc. for fixating the glazed window structure within a surrounding building or in front of the building from the outside or from the inside provided the building element be used as a door, a port or a large size window structure.

Figure 5F:
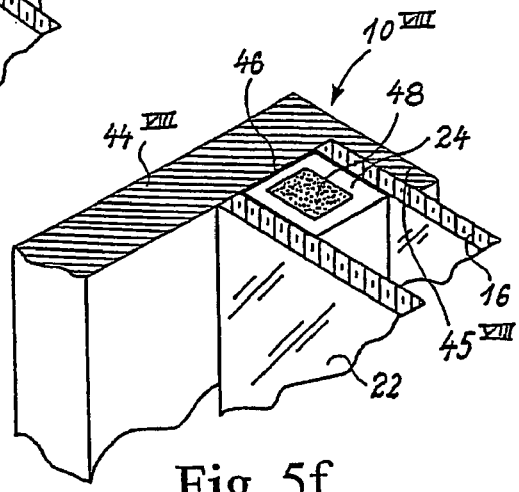

In FIG. 5*f*, a modified version of the building element $\mathbf{10}^{iii}$ shown in FIG. 5*a* is represented in which modified version designated the reference numeral $\mathbf{10}^{vii}$ in its entirety, the outwardly pultruding flange 45 is substituted by an orthogonal flange $45^{viii}$ which serves as an outer covering of the glazed window structure as the flange $45^{vii}$ covers the outer side of the glazed window structure or building element structure.

The technique of providing an integral building element or glazed window having a pultruded distance element or a similar distance element made through extrusion, pulforming of thermosetting resins or alternatively extrusion of fiber reinforced polymer material, in particular glass fiber reinforced polymer material allows the easy manufacture of an integral window frame and glazed window structure having more than two glass panels.

Figure 6:
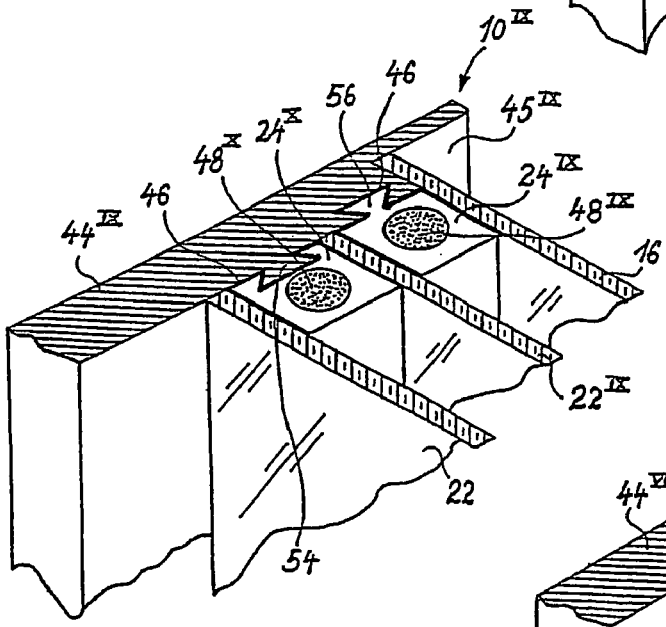
FIG. 6 is a perspective, schematic and partly cutaway view similar to the views of FIGS. 5*a*-5*f* of a further variant of a three layer glazed window structure including an integral window frame.

In FIG. 6, a building element or glazed window structure $10^{ix}$ is shown comprising the outer glass panel 16 and the inner glass panel 22 and further an intermediate glass panel $22^{ix}$. The inner glass panel 22 and the intermediate glass panel $22^{ix}$ may be made from non-laminated and non-hardened glass as is well known in the technical field of manufacture of glazed window per se whereas the outer glass panel 16 may be made from a simple window pane or alternatively and preferably, if the building element or the glazed window structure is of a fairly large size, made from laminated high strength glass or even hardened glass.

In FIG. 6, the distance elements of the three window pane glazed window structure $10^{ix}$ are slightly different from one another as the one distance element $24^{ix}$ separating the outer glass panel 16 from the intermediate glass panel $22^{ix}$ is provided with an outwardly pultruding dovetail flange 56 for co-operating with a similar recess of the pultruded flange body $44^{ix}$, whereas the distance element $24^{x}$ separating the intermediate glass panel $22^{ix}$ from the inner glass panel 22 is provided with a recess for receiving an outwardly pultruded dovetail flange 54 of the pultruded flange body $44^{ix}$. The technique of arresting the three window pane glazed window structure of FIG. 6 relative to a circumferential flange by means of dovetail fixtures may be modified in numerous ways by the use of differently configured arresting fittings or snap fittings and similarly, the technique of using a dovetail fixture or similar snap fitting fixture may be used in the two window pane glazed window structures described above or in similar structures constituting a modification of e.g. the building element or glazed window structure $10^{iii}$ shown in FIG. 5*a*.

Figure 7:
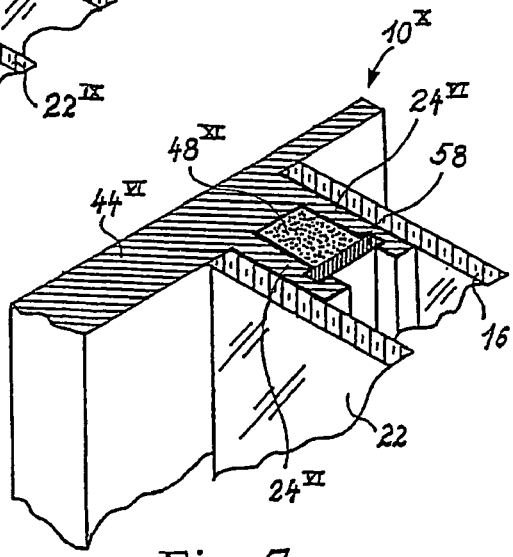
FIG. 7 is a perspective, schematic and partly cutaway view similar to the views of FIGS. 5*a*-5*f* and FIG. 6 of a further modified embodiment of a building element or alternatively a glazed window structure having an integral window frame.

In FIG. 7, a slightly modified version of the building element or glazed window structure $10^{vi}$ shown in FIG. 5*d* is illustrated, which modified version is designated by the reference numeral $10^{x}$ in its entirety. In FIG. 7, the vapor absorbing substance which in FIG. 5 *d* is constituted by a separate self supporting body or a foamed string or similar element is constituted by a filling $48^{xi}$ which is kept in a space defined by the flange body $44^{vi}$, the two inwardly pultruding flanges $24^{vi}$ and a separation wall component 58 which is preferably made from a water permeable polymer material allowing any vapor present within the space defined between the two glass panels 16 and 22 to permeate through the wall component 58 into the water absorbing substance $48^{xi}$.

Figure 8:
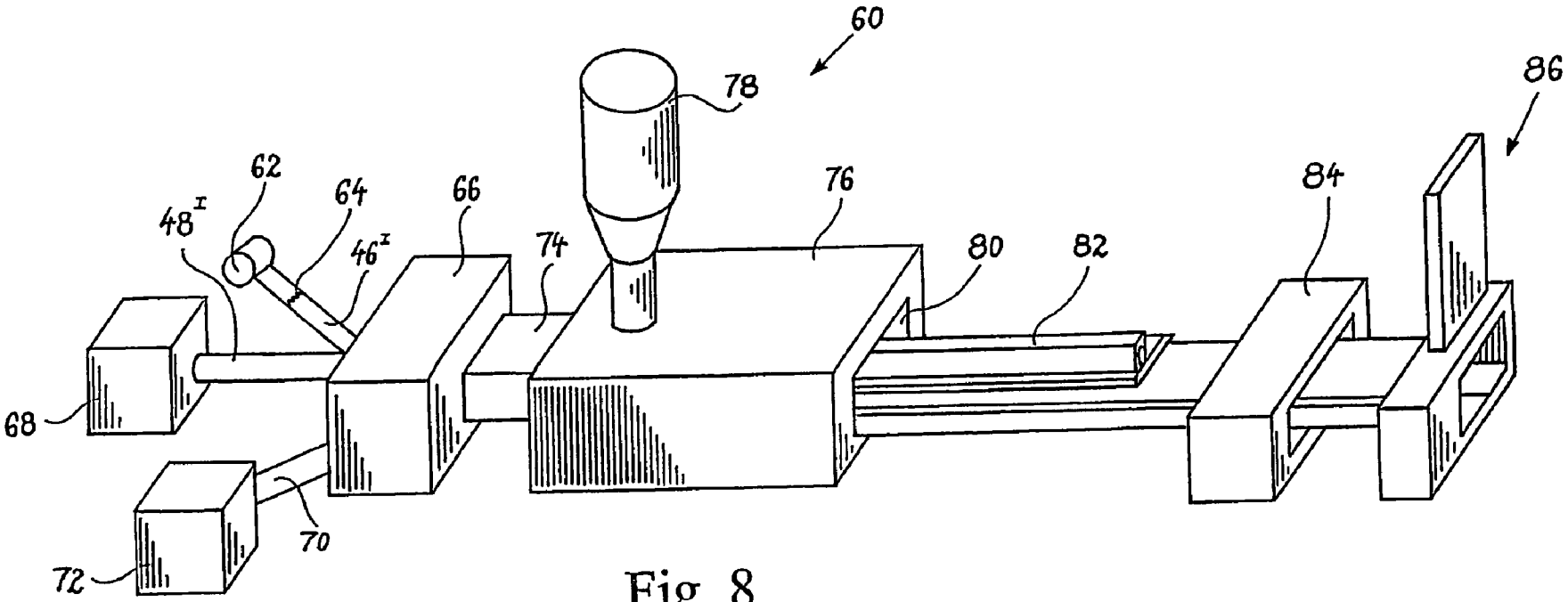
FIG. 8 is an overall schematic view of a pultrusion plant for the manufacture of pultruded elements for the building elements as described above or for the manufacture of an integral distance element and window frame of a glazed window structure.

In the above description the pultrusion technique has generally been described as the preferred technique for the manufacture of the distance elements of the building element or glazed window structure and also for the manufacture of the highly insulating frames or wall components. In FIG. 8, a pultrusion plant is shown designated by the reference numeral 60 in its entirety. The pultrusion plant 60 shown in FIG. 8 is specifically adapted for the manufacture of the integral building element or glazed window structure $10^{v}$ shown in FIG. 5*c* as a roller 62 is shown from which the vapor barrier foil $46^{i}$ is supplied and corrugated into the foil structure shown in FIG. 5*c* as the foil is guided through a corrugation and folding tool which tool is designated by the reference numeral 64. The corrugated and folded vapor barrier $46^{i}$ is introduced into a receiving section 66 which also receives a string $48^{i}$ of the vapor absorbing substance $48^{i}$ supplied from an extruder 68 and further receives a bundle of glass fibers 70 supplied from a glass fiber supply 72. The corrugated and folded vapor barrier foil $66^{i}$, the extruded vapor absorbing substance $48^{i}$ and further the reinforcing glass fibers 70 are jointly received within the receiving section 66 and guided from the receiving section as a combined string 74 into a resin applicator and resin heating and curing apparatus 76. An output die of the apparatus 76 is designated by the reference numeral 80 and provides a specific configured shaping of a pultrusion string 82 delivered from the die 80 of the apparatus 76 which string 82 is introduced into a puller apparatus 84 for pulling the pultrusion string 82 from the die 80 of the apparatus 76.

From the puller 84, the string 82 is delivered to a cutter 86 which separates the string 82 into distinct sections constituting the integral body shown in FIG. 5*c* constituted by the distance body $24^{v}$ and the frame body $44^{v}$ integrally including the vapor absorbing substance $48^{i}$ and the vapor barrier foil 46*i*.

The pultrusion plant 60 shown in FIG. 8 may readily, as will be understood by a person having ordinary skill in the art, be modified for integrally manufacturing the various elements and bodies described above with reference to FIGS. 1-7 including the combined distance element and frame elements and furthermore, the pultrusion apparatus may be modified by the addition of an extruder e.g. for the jointly manufacture of a pultruded distance body and an extruded frame element or vice versa.

A prototype embodiment of a building element 10 shown in FIG. 1 was made from the following components. The glass panel 16 was made from 4 mm hardened glass measuring 40 cm×40 cm. The glass panel 22 was made from 4 mm non-hardened glass measuring 40 cm×37.8 cm. The distance elements 22 and 24 were made from 12 mm×12 mm aluminum profiles which were adhered to the sandwiching glass panel 16 and 22 by means of UV resistant silicone. The pultruded bodies 12 and 14 were constituted by two bodies of a length of 40 cm made from a 10 mm×100 mm pultruded profile made from polyester having a content of glass fibers of approximately 60% by weight.

The above described technique of providing a self-supporting lightweight and high strength building element by means of co-operating pultruded bodies having a high content of glass fibers for generating a pultruded body having a coefficient of thermal expansion substantially corresponding to the coefficient of thermal expansion of glass and a hardened glass panel may be modified in numerous ways e.g. by further providing additional pultruded elements or bodies positioned at the top and bottom edges of the glass panel. In the above-described embodiments shown in FIGS. 3 and 4, it is contemplated that the pultruded bodies 12 and 14 constitute vertical supporting bars, however, in an alternative application of the hnique according to the present invention, the pultruded bodies may serve as horizontal bars or alternatively a total of four pultruded bodies constituting vertical and horizontal bars may be used, which bars together constitute a circumferential frame which is adhered to the outer glass panel 16. The technique of adhering frame made from pultruded bodies having a coefficient of thermal expansion substantially corresponding to the coefficient of thermal expansion of glass due to the high content of glass fibres fibers within the pultruded bodies may be further employed in integral window structures being single glass layer window structures or two layer or three layer glazed windows having an integral window frame.

The above-mentioned modifications and numerous other modifications and variants which will be evident to a person having ordinary skill within the art, are contemplated to be part of the present invention as defined in the appending patent claims.

The invention claimed is:

1. A building element comprising:

a self-supporting, load-bearing glass panel defining an outer rim including first and second opposed vertical segments of a predefined length, and first and second opposed horizontal segments, said glass panel having a specific coefficient of thermal expansion; and no more than first and second pultruded elements, each having a length equal to said predefined length, adhered in a high strength integral adhesion to said glass panel along only said first and second vertical segments, respectively, whereby none of said pultruded elements is adhered to said glass panel along either of said first and second horizontal segments;

wherein said pultruded elements having a content of reinforcing fibers that provides a coefficient of thermal expansion of said pultruded elements approximately equal to said specific coefficient of thermal expansion.

2. The building element according to claim 1, said fibers being glass fibers.

3. The building element according to claim 1, wherein the content of fibers of said pultruded elements is more than 40% by weight.

4. The building element according to claim 1, said first and second pultruded elements being adhered to said self-supporting, load-bearing glass panel by means of at least one of a PU adhesive and an epoxy adhesive.

5. The building element according to claim 1, wherein said selfsupporting, load-bearing glass panel is a first self-supporting, load-bearing glass panel, said building element further comprising a second self-supporting, load-bearing glass panel positioned in a spaced apart relationship relative to said first self-supporting, load-bearing glass panel by means of distance elements for providing a glazed window.

6. The building element according to claim 5, each of said distance elements comprising an extension of one of said pultruded elements.

7. The building element according to claim 6, said distance elements further including a vapor absorbing substance.

8. The building element according to claim 6, further including a gas tight foil between said first and second self-supporting, load-bearing glass panels.

9. The building element according to claim 8, said gas tight foil being integrally included within said distance elements in an integral pultrusion or pultrusion/extrusion process.

10. A method of producing a building element comprising:

providing a self-supporting, load-bearing glass panel defining an outer rim including first and second opposed vertical segments of a predefined length, and first and second opposed horizontal segments, said glass panel having a specific coefficient of thermal expansion;

providing first and second pultruded elements, said pultruded elements, each having a length equal to said predefined length and having a content of reinforcing fibers that provides a coefficient of thermal expansion of said pultruded elements approximately equal to said specific coefficient of thermal expansion; and adhering said self-supporting, load-bearing glass panel to said first and second pultruded elements in a high strength integral adhesion along only said first and second vertical segments, respectively.

11. The method according to claim 10, said fibers being glass fibers.

* * * * *